United States Patent [19]

Van Thematt

[11] Patent Number: 4,764,756

[45] Date of Patent: Aug. 16, 1988

[54] INTRUSION DETECTOR USING A VIBRATION-RESPONSIVE CABLE

[75] Inventor: Hendrik M. V. L. Van Thematt, Pretoria, South Africa

[73] Assignee: Sekerheid en Elektronika Laboratoria (Eiendoms) Beperk, Pretoria, South Africa

[21] Appl. No.: 907,884

[22] Filed: Sep. 16, 1986

[30] Foreign Application Priority Data

Sep. 17, 1985 [ZA] South Africa ..... 85/7130

[51] Int. Cl.[4] ..... G08B 13/22

[52] U.S. Cl. ..... 340/566; 340/524

[58] Field of Search ..... 340/566, 524

[56] References Cited

U.S. PATENT DOCUMENTS

| | | | |
|---|---|---|---|
| 3,831,162 | 8/1974 | Armstrong | 340/566 |
| 3,836,899 | 9/1974 | Duvall et al. | 340/566 |
| 3,947,835 | 3/1976 | Laymon | 340/566 |
| 4,097,025 | 6/1978 | Dettmann et al. | 340/566 |
| 4,144,530 | 3/1979 | Redfern | 340/566 |

OTHER PUBLICATIONS

Bennett et al., "Bosworth Group Project 1978—Vehicle Recognition Radar," pp. 4/2, 4/3, 5/17, 6/15, 6/28–6/34, 6/43, 7/15–7/18, 7/21, and 7/22 with Appendix A, Master's Thesis published at Birmingham University, United Kingdom, 1978.

Article entitled "Development of Electric Transducer Line Sensors", by Dr. G. Kirby-Miller, GTE Sylvania Inc. (pp. 22 to 24).

Brochure entitled "Installation and Operating Instructions Fence Protection System FPS-2", Aug. 1978, GTE Sylvania Inc.

Brochure entitled "Installation Manual Model E-4/E.4 HR Control Unit E-Flex Perimeter Protection System", produced by Stellar Systems, Inc. (Aug. 1984).

Pamphlet entitled "Competitive Evaluation Fence-Mounted Sensors", produced by S. E. L. (Pty) Ltd., Feb. 1983.

*Primary Examiner*—Glen R. Swann, III

*Attorney, Agent, or Firm*—Willian Brinks Olds Hofer Gilson & Lione Ltd.

[57] ABSTRACT

A protective device includes a transmission line comprising two elongate co-extensive electrical conductors capable of sensing vibrations, converting these vibrations into electrical signals and transmitting the electrical signals. It also includes signal-processing means electrically connected to one pair of ends of the conductors. The signal-processing means includes normalizing means for normalizing the electrical signals, and a comparator for comparing the normalized signals with previously normalized known signals, thereby to identify the source of the signals transmitted along the cable, and hence an alarm/non-alarm condition.

21 Claims, 2 Drawing Sheets

INTRUSION DETECTOR USING A VIBRATION-RESPONSIVE CABLE

FIELD OF THE INVENTION

This invention relates to the protection of property. It relates in particular to a method of identifying an alarm condition in a protective installation, to a protective device, and to a protective installation.

BROAD DESCRIPTION OF THE INVENTION

According to a first aspect of the invention, in a protective installation comprising a barrier and a co-axial cable extending along the barrier, the cable having an inner and an outer conductor, and being capable of sensing vibrations, converting these vibrations into electrical signals and transmitting the electrical signals, a method of identifying an alarm condition which includes allowing, on a section of the cable being subjected to vibrations, electrical signals to be transmitted along the cable;

normalizing these signals; and comparing the normalized signals with previously normalized known signals thereby to identify the source of the signals transmitted along the cable, and hence an alarm/non-alarm condition.

The transmission of the signals may be effected on either side of the said cable section, so that a first set of signals is transmitted to the one end of the cable and a second set of signals to the other end of the cable. The method may then include overlaying the first set of signals with the second set of signals. In this manner the position of said cable section, i.e. the position of intrusion/penetration, or attempted intrusion/penetration, of the barrier can be determined.

In one embodiment of the invention, the signal overlaying may be effected by providing a mismatched load between the inner and outer conductors of the cable at a first end of the cable, and allowing the first set of electrical signals to be transmitted directly along the cable from said cable section to the other second end of the cable, while the second set of electrical signals is allowed to be reflected along the cable due to the mismatched load.

The method may include correlating the direct and reflected signals, thereby to produce enhanced signals; determing the time interval required to effect this correlation; and utilizing the enhanced signals and the time interval or delay to effect the comparison and to determine said position of intrusion/penetration or attempted intrusion/penetration. The method may include, prior to correlating the signals, amplifying the transmitted signals, and may further include compensating the signals for not emanating from a point source.

In one embodiment, the method may include converting the amplified signals to digital signals. In another embodiment, the method may include processing the amplified signals in an analogue fashion, e.g. by using surface acoustical wave ('SAW') devices.

The previously normalized known signals, which can also have been compensated for for not emanating from a point source, may include known aggressive signals as well as known non-aggressive signals. By 'known aggressive signals' is meant signals emanating from known sources, e.g. blows with an instrument, cutting etc. which are normally associated with unwanted or hostile activities e.g. attempted penetration/instrusion of the barrier. By 'known non-aggressive signals' is hence analogously meant signals emanating from known sources which are normally associated with everyday activities e.g. wind, animals or the like.

The method may hence include correlating the enhanced signals with known aggressive and non-aggressive signals or signatures, and issuing a warning on the enhanced signals corresponding exactly or in excess of a predetermined degree of certainty with a known aggressive signal or signature, and/or on the enhanced signal not corresponding above a predetermined degree of certainty with a known non-aggressive signal or signature.

In another embodiment of the invention, the signal overlaying may be effected by allowing the first and second sets of signals to be transmitted to the respective ends of the cable;

amplifying these signals;

correlating the amplified signals to produce enhanced signals;

determing the time interval required to effect this correlation, i.e. to produce the enhanced signals; and utilizing this time interval to determine the position of said section.

According to a second aspect of the invention, there is provided a protective device which includes a transmission line comprising at least two elongate co-extensive electrical conductors capable of sensing vibrations, converting these vibrations into electrical signals and transmitting the electrical signals; and signal-processing means electrically connected to at least one pair of ends of the conductors, the signal-processing means including normalizing means for normalizing the electrical signals, and a comparator for comparing these normalized signals with previously normalized known signals, thereby to identify the source of the signals transmitted along the cable, and hence an alarm/non-alarm condition.

The signal-processing means may also include overlaying means responsive to said normalized signals, to overlay first and second sets of electrical signals transmitted respectively along the conductors on either side of a section of the conductors when said section is subjected to the vibrations, thereby to determine the position of said section.

The transmission line may be in the form of a co-axial cable, the one conductor being the inner conductor or core of the cable and the other the outer conductor of the cable.

In one embodiment of the invention, the device may include a mismatched load between a first pair of ends of the conductors, the signal-processing means then being connected to the second pair of ends of the conductors, and the overlaying means being capable of overlaying a first set of electrical signals transmitted directly from the section by the conductors to their second pair of ends, with a second set of electrical signals reflected along the conductors from their first pair of ends, due to the mismatched load.

The signal-processing means may include an amplifier for amplifying the transmitted signals. In one version, the signal-processing means includes a converter for converting the transmitted signals to digital signals. In another version, the signal-processing means may include a device, such as a SAW device, to perform signal-processing while the signals remain in analogue form.

The overlaying means may include a compensator responsive to transmitted signals into emanating from a point source, to compensate these signals. The overlaying means may further include a correlator/timer for correlating the direct and reflected signals to produce enhanced signals, determing the time interval required to effect this correlation, and using this time interval to determine the position of said section. The signal-processing means may include a first memory or other variable delay device for the compensated and normalized signals.

The signal-processing means may further include a complex correlator for correlating the enhanced signals with known aggressive and non-aggressive signals or signatures; and, optionally, a second memory for storing the known aggressive and non-aggressive signals or signatures in.

The signal-processing means may still further include a decision-making device and warning means responsive to the decision-making device, so that is is actuated on the enhanced signals corresponding either directly or in excess of a predetermined degree of certainty with a known aggressive signal or signature, and/or on the enhanced signals not corresponding above a predetermined degree of certainty with a known non-aggressive signal or signature.

The signal-processing means may also include a position indicator responsive to the correlator/timer, for indicating the position of intrusion/penetration or attempted intrusion/penetration.

The amplifier, converter, memories, compensator, correlator/timer, complex correlation and decision-making device may be components of and/or be provided by an electrical-electronically operable processor.

In another embodiment of the invention, the signal-processing means may include an amplifier electrically connected to each end of the cable, the amplifier being electrically connected to the correlator/timer.

According to a third aspect of the invention, there is provided a protective installation which includes a protective barrier; and a protective device hereinbefore described, the transmission line of the device extending along the barrier.

The barrier may surround a property to be protected.

The invention will now be described by way of example with reference to the accompanying diagrammatic drawings.

BRIEF DESCRIPTION OF THE INVENTION

In the drawings,

FIG. 1 shows a block diagram of a protective device according to one embodiment of the second aspect of the invention; and FIG. 2 shows a block diagram of a protective device according to another embodiment of the second aspect of the invention.

DESCRIPTION OF THE PREFERRED EMBODIMENTS

Figure 1:
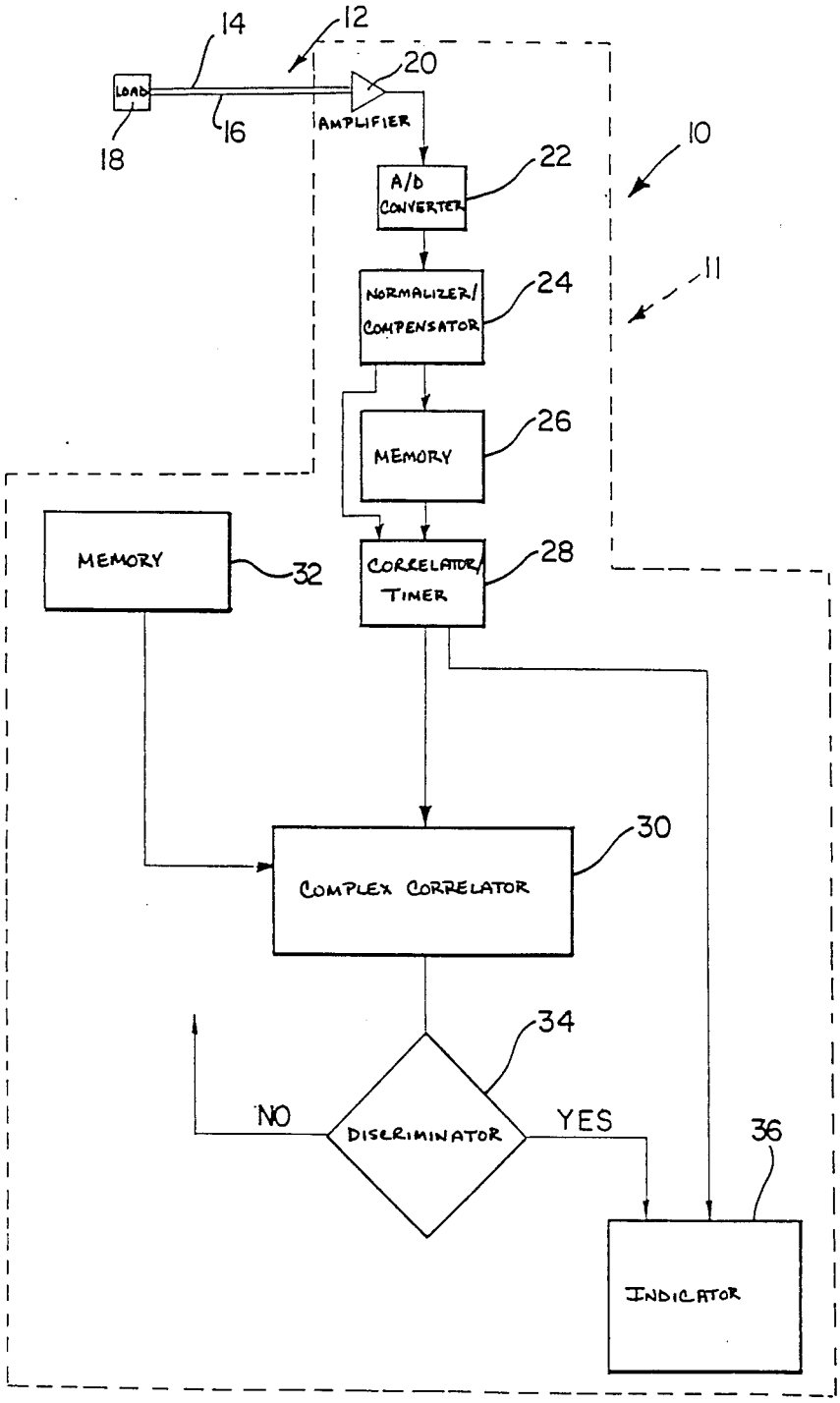

Referring to FIG. 1, reference numeral 10 generally indicates a protective device according to one embodiment of the second aspect of the invention.

The device 10 includes a co-axial cable 12 and signal-processing means 11. The cable extends along a barrier (not shown), e.g. a fence, or a brick or concrete wall, extending upwardly from the ground (not shown) and surrounding a property to be protected (not shown), e.g. a building structure. For example, the co-axial cable 12 may be located inside a conduit (not shown) extending more or less horizontally along the barrier. The coaxial cable 12 comprises an inner conductor 14, and an outer conductor 16 located co-axially around the inner conductor 14 and insulated therefrom by means of di-electric material (not shown).

A mismatched load 18 is applied between the conductors 14, 16 at a first pair of ends of the conductors. To their other pair of ends there is connected an amplifier 20 which forms part of the signal-processing means 11. An analog-to-digital (A/D) converter 22 is responsive to the amplifier 20, and to a normalizer/compensator 24. A memory or other variable delay device 26 is responsive to the normalizer/compensator 24, and a correlator/timer 28 is responsive to the memory 26.

A complex correlator 30 is responsive to the correlator/timer 28, as well as to a memory 32. A decision-making device or discriminator 34 is responsive to the correlator 30, and a combined warning means/position indicator 36 is responsive to the discriminator 34. The indicator 36 is also responsive to the correlator/timer 28.

Typically, the signal-processing means 11 may be provided by an electrical processor (not shown).

In use, on intrusion/penetration or attempted intrusion/penetration of the barrier, for example by blows with a hammer being imparted to a section of the barrier, a barrier section being scaled, etc., vibrations, e.g. in the acoustical range, are sensed by a corresponding section of the conductors 14, 16. These signals are converted to electrical signals which are transmitted by the conductors 14, 16. Hence, the co-axial cable acts as a microphonic transducer. These signals comprise a first set of direct signals transmitted directly by the conductors to the amplifier 20 as well as a second set of reflected signals which are firstly transmitted by the conductors to the mismatched load 18 and which thereafter, due to the mismatching of the load 18, are reflected along the conductors to the amplifier 20. The amplifier 20 amplifies the direct as well as the reflected signals, and these are converted to digital signals by the A/D converter 22.

As the acoustic vibration signals will usually not emanate from a point source, i.e. they will be spread over a section of the cable, they are compensated for for not emanating from a point source in the compensator 24. The compensator also normalizes these signals. Typically, this can be done by normalizing the signal around the highest amplitude present in a range or set of amplitudes caused by a vibration. Further compensation is possible by multiplying each digital signal sampled by the compensator, with a sinusoid angle factor where the zero angle is regarded as being at the sample with the highest amplitude. The normalization also reduces the likelihood of signals attenuated by transmission over long distances failing to trigger the system. Hence with the present invention cables of lengths of 500 m or longer can be used, and said normalization ensures that effective triggering is nevertheless effected. For example, an amplitude exceeding a specified limit can be used to trigger the system or process; due to the normalization, this triggering or threshold amplitude can be made more sensitive than would be the case without said normalization. Line amplifiers (not shown) can also be provided in the cable 12 if desired.

Normalized and compensated signals are then stored in a memory 26, and from there they pass to the correlator/timer 28. The correlator/timer 28 continually correlates the stored signals with further incoming signals. The time period or delay to effect the highest degree of correlation is taken as the time delay between the reflected and direct signals. In this fashion the correlator/timer 28 measures the time delay between the direct and the reflected signals, and overlays them. By means of this time measurement, and since the signal transmission speed of the cable is known, the position of intrusion/penetration or attempted intrusion/penetration of the barrier, relative to the first end of the cable, can be determined by the correlator 28. This data is fed to the device 36 which indicates the position of the intrusion/penetration or attempted intrusion/penetration. This is typically done by multiplying the time delay with a constant, and displaying the result, e.g. on a display screen.

These steps all occur extremely fast since the signal transmission speed is typically about $3\times10^8$ m/sec. Therefore, a signal delay or difference in timing between the signals of $1\times10^{-9}$ seconds indicates the area of penetration/intrusion as being located 150 mm from the first end of the cable. Typically, a resolution of accuracy of 150 metres, i.e. equivalent to $1\times10^{-6}$ seconds time difference or delay is acceptable. The correlator 30 can for example, function by determining the Fourier transform of each of the signals to be compared; taking the negative of the imaginary portion of one of these, multiplying the resultant value; and doing an inverse Fourier transform. The correlation is a function of the first term in the resultant value obtained.

The direct and reflected signal overlaying in the correlator 28 also produces enhanced signals. In particular, the product of a first correlation is stored in a memory of the correlator 28, and replaced with any higher, i.e. of greater magnitude, incoming correlation products, and the enhanced signals produced therefrom. The complex correlator 30 is responsive to the enhanced signals. The complex correlator compares both the imaginary and the real parts of the enhanced signals with known aggressive signatures from the memory 32, comparison being effected in respect of relative phase angles, amplitude and frequency, in the frequency domain. On the enhanced signal corresponding exactly with a known signature, the decision-making device actuates the warning means 36, if the known signature is an aggressive signature, and cancelling the process if the known signal is a non-aggressive signal. The warning means 36 may be an aural warning means. The decision-making device 34 is also adapted to function in this manner on the enhanced signal corresponding above a predetermined degree of certainty, for example above about 70%, with a known signature. If it corresponds to a lesser extent than said predetermined degree, the decision-making device either ignores the signals transmitted by the conductors 14, 16, or creates an 'unknown source' alarm.

A library of known aggressive/non-aggressive signals can hence be built up. The processer can be adapted or programmed to update the library of known signals in the memory 32 continuously on 'false alarms' being experienced.

The Applicant believes that with the device 10, false warnings will largely be eliminated and that accurate and consistent pin-pointing of the position of penetration/intrusion can be effected. Furthermore the device is not dependent on operators, who could tend to lose their ability to discriminate when subjected to extended periods of intensive listening to aural warning signals, monitoring, and interpreting the warning signals generated.

In another embodiment (not shown), the A/D converter 22 can be dispensed with so that the signals will then be processed in analogue form. Instead of the memory 26, another variable delay device can then be used. For example, the memory 26 and the compensator 24 can be replaced by a SAW device. The signal-processing means 11 may hence be provided by an analogue processor incorporating the SAW device. Analogue signal-processing by means of such a SAW device can be very useful to achieve the short time delays mentioned hereinbefore.

Figure 2:
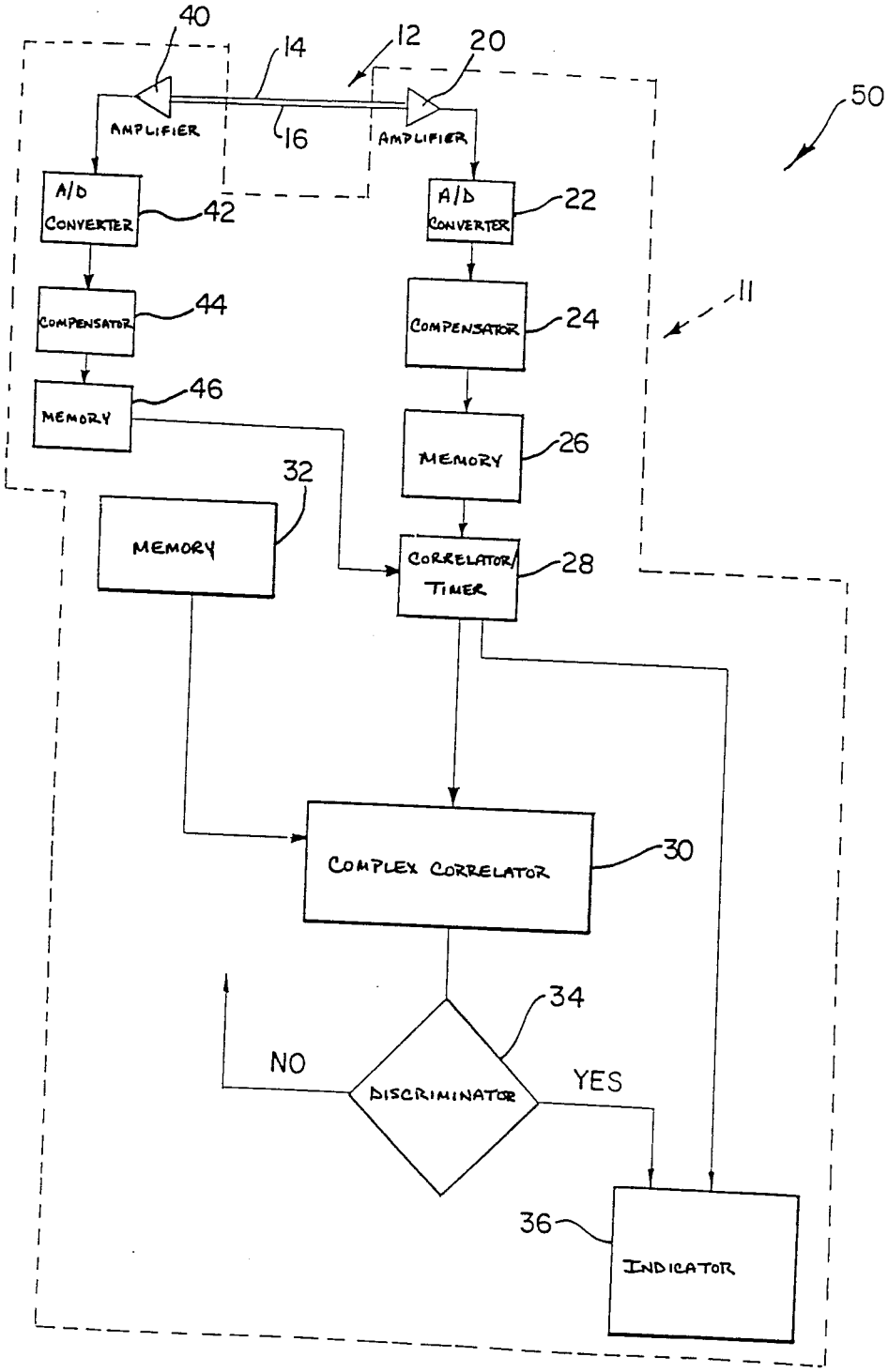

Referring to FIG. 2, reference numeral 50 generally indicates a protective device according to another embodiment of the second aspect of the invention.

Parts of the device 50 which are the same as or similar to those of the device 11 hereinbefore described, are indicated with the same reference numerals.

In the device 50, the first end of the cable is connected to an amplifier 40 which is similar to the amplifier 20 connected to the second end of the cable. The amplifier 40 is electrically connected to and A/D converter 42, a compensator 44, memory 46, and to the correlator/timer 28.

The correlator/timer 28 will hence overlay first and second signals transmitted respectively by the conductors to the first and second ends of the cable from the area of sensing of the vibration signals. In this fashion the position of intrusion/penetration or attempted intrusion/penetration, relative to the centre of the cable can also be determined with a resolution of 150 mm for $1\times10^{-9}$ seconds delay.

What is claimed is:

1. In a protective installation comprising a barrier and a co-axial cable extending along the barrier, the cable having an inner and an outer conductor, and being capable of sensing vibrations, converting these vibrations into electrical signals and transmitting the electrical signals, a method of identifying an alarm condition, which includes allowing, on a section of the cable being subjected to vibrations, electrical signals to be transmitted along the cable;

normalizing these signals; and comparing the normalized signals with previously normalized known signals thereby to identify the source of the signals transmitted along the cable, and hence an alarm/non-alarm condition.

2. A method according to claim 1 wherein the transmission of the signals is effected on both sides of said cable section so that a first set of signals is transmitted to one end of the cable and a second set of signals to the other end of the cable, the method including overlaying the first set of signals with the second set of signals, to determine the position of said section.

3. A method according to claim 2, wherein the signal overlaying includes providing a mismatched load between the inner and outer conductors of the cable at a first end of the cable, and allowing the first set of electrical signals to be transmitted directly along the cable from said section to the other second end of the cable, while the second set of electrical signals is allowed to be reflected along the cable due to the mismatched load.

4. A method according to claim 3, which includes correlating the direct and reflected signals to produce enhancd signals; determining the time interval required to effect this correlation; and utilizing the enhanced signals and time interval to effect the comparison and to determine the position of the said section.

5. A method according to claim 4, which includes, prior to correlating the signals, amplifying transmitted signals and compensating the signals for not emanating from a point source.

6. A method according to claim 4, wherein the correlation is effected with knwon aggressive or non-aggressive signals, and wherein a warning is issued when the enhanced signals correspond in excess of a predetermined degree of certainty with a known aggressive signal.

7. A method according to claim 4, wherein the correlation is effected with known aggressive or non-aggressive signals, and wherein a warning is issued when the enhanced signals do not correspond above a predetermined degree of certainty with a known non-aggressive signal.

8. A method according to claim 2, which includes allowing the first and second sets of signals to be transmitted directly to the respective ends of the cable;

amplifying these signals;

correlating the amplified signals to produce enhanced signals;

determining the interval to effect this correlation; and utilizing this time interval to determine said position.

9. A protective device which includes a transmission line comprising at least two elongate co-extensive electrical conductors capable of sensing vibrations, converting these vibrations into electrical signals and transmitting the electrical signals; and signal-processing means electrically connected to at least one pair of ends of the conductors, the signal-processing means including normalizing means for normalizing the electrical signals, and a comparator for comparing the normalized signals with previously normalized known signals, thereby to identify the source of the signals transmitted along the cable, and hence an alarm/non-alarm condition.

10. A device according to claim 9 wherein the signal processing means includes overlaying means responsive to said normalized signals, to overlay first and second sets of electrical signals transmitted respectively along the conductors on either side of a section of the conductors when said section is subjected to the vibrations, thereby to determine the position of said section.

11. A device according to claim 10, wherein the transmission line is in the form of a co-axial cable, the one conductor being the inner conductor or core of the cable and the other the outer conductor of the cable.

12. A device according to claim 10, which includes a mismatched load between a first pair of ends of the conductors, the signal-processing means then being connected to the second pair of ends of the conductors, and the overlaying means being capable of overlaying a first set of electrical signals transmitted directly from the section by the conductors to their second pair of ends, with a second set of electrical signals reflected along the conductors from their first pair of ends, due to the mismatched load.

13. A device according to claim 12, wherein the signal-processing means includes an amplifier for amplifying the transmitted signals.

14. A device according to claim 12, wherein the overlaying means includes a compensator responsive to transmitted signals not emanating from a point source, to compensate these signals; and a correlator/timer for correlating the direct and reflected signals to produce enhanced signals, determining the time interval required to effect this correlation, and using this time interval to determine the position of said section.

15. A device according to claim 14, wherein the signal-processing means includes a variable delay device for the compensated signals.

16. A device according to claim 14, wherein the signal-processing means includes a complex correlator for correlating the enhanced signals with known aggressive and non-aggressive signals, and a memory for storing the known signals.

17. A device according to claim 16, wherein the signal-processing means includes a decision-making device and warning means responsive to the decision-making device, so that said warning means is actuated when the enhanced signals correspond in excess of a predetermined degree of certainty with a known aggressive signal.

18. A device according to claim 16, wherein the signal-processing means includes a decision-making device and warning means responsive to the decision-making device, so that said warning means is actuated when the enhanced signals do not correspond above a predetermined degree of certainty with a known non-aggressive signal.

19. A device according to claim 14, wherein the signal-processing means includes a position indicator responsive to the correlator/timer, for indicating the position of intrusion/penetration or attempted intrusion/-penetration.

20. A device according to claim 10, wherein the signal-processing means includes a signal correlator/timing for correlating and timing the signals; and an amplifier electrically connected to each end of the cable, each amplifier being electrically connected to the correlator/timer.

21. A protective device according to claim 9, which includes a protective barrier, with the transmission line extending along the barrier.

* * * * *

UNITED STATES PATENT AND TRADEMARK OFFICE

CERTIFICATE OF CORRECTION

PATENT NO. : 4,764,756

DATED : August 16, 1988

INVENTOR(S) : Hendrik M.V.L. Van Themaat

It is certified that error appears in the above-identified patent and that said Letters Patent is hereby corrected as shown below:

Please change the name of the inventor in all instances by deleting "Van Thematt" and substituting therefor --Van Themaat--.

IN OTHER PUBLICATIONS

On the cover sheet in column 2, line 2, please delete "(pp. 22 to 24)" and substitute therefor --(pp. 22 to 25)--.

IN THE BROAD DESCRIPTION OF THE INVENTION

In column 1, line 48, please delete "determing" and substitute therefor --determining--.

In column 1, line 62, please delete the first occurrence of "for".

In column 3, line 2, please delete "into" and substitute therefor --not--.

In column 3, line 6, please delete "determing" and substitute therefor --determining--.

In column 3, line 20, please delete "is", first occurrence and substitute therefor --it--.

In column 3, line 32, please delete "correlation" and substitute therefor --correlator--.

UNITED STATES PATENT AND TRADEMARK OFFICE

CERTIFICATE OF CORRECTION

PATENT NO. : 4,764,756

DATED : August 16, 1988

INVENTOR(S) : Hendrik M.V.L. Van Themaat

It is certified that error appears in the above-identified patent and that said Letters Patent is hereby corrected as shown below:

IN THE DESCRIPTION OF
THE PREFERRED EMBODIMENTS

In column 4, line 4, please delete "coaxial" and substitute therefor --co-axial--.

In column 4, line 46, please delete the second occurrence of "for".

In column 5, line 23, please delete the second occurrence of "of" and substitute therefor --or--.

In column 6, line 24, please delete "and" and substitute therefore --an--.

IN THE CLAIMS

In column 6, line 68, please delete "enhancd" and substitute therefor --enhanced--.

In column 7, line 5, after "amplifying" please insert --the--.

In column 7, line 9, please delete "knwon" and substitute therefor --known--.

UNITED STATES PATENT AND TRADEMARK OFFICE

CERTIFICATE OF CORRECTION

PATENT NO. : 4,764,756

DATED : August 16, 1988

INVENTOR(S) : Hendrik M.V.L. Van Themaat

It is certified that error appears in the above-identified patent and that said Letters Patent is hereby corrected as shown below:

In column 7, line 27, after "the" please insert --time--.

In column 8, line 48, please delete "timing" and substitute therefor --timer--.

Signed and Sealed this

First Day of August, 1989

*Attest:*

*Attesting Officer*

DONALD J. QUIGG

*Commissioner of Patents and Trademarks*